United States Patent [19]

Jacobs

[11] 4,165,779

[45] Aug. 28, 1979

[54] PLEATED DRAW DRAPE

[75] Inventor: Lawrence O. Jacobs, Richmond, Va.

[73] Assignee: Plastic Products, Inc., Richmond, Va.

[21] Appl. No.: 912,679

[22] Filed: Jun. 5, 1978

Related U.S. Application Data

[63] Continuation-in-part of Ser. No. 767,099, Feb. 9, 1977.

[51] Int. Cl.[2] ..... A47H 13/14

[52] U.S. Cl. ..... 160/348

[58] Field of Search ..... 160/348

[56] References Cited

U.S. PATENT DOCUMENTS

| | | | |
|---|---|---|---|
| 2,658,551 | 11/1953 | Bender | 156/380 |
| 3,084,738 | 4/1963 | Truesdale | 160/330 |
| 3,132,686 | 5/1964 | Judovits | 160/348 |
| 3,392,890 | 7/1968 | Cramer | 223/28 |
| 3,559,717 | 2/1971 | Kalder | 160/348 |

*Primary Examiner*—Peter M. Caun

*Attorney, Agent, or Firm*—Norman B. Rainer

[57] ABSTRACT

A draw drape is provided having a number of pleat assemblies located at uniformly spaced intervals within a stiffened heading border. Each pleat assembly consists of one, two or three separate loops fixed in position by cohesive bonding to a reinforced backing strip. The bonding occurs at the base of the folds bracketing said loops and at the bight of each loop in vertically elongated parallel regions extending the height of said border. A separate backing strip is utilized for each pleat assembly.

12 Claims, 4 Drawing Figures

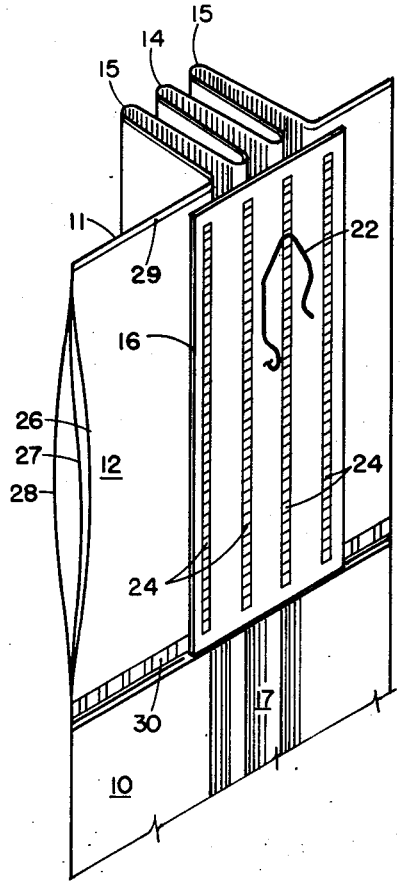

PLEATED DRAW DRAPE

RELATED APPLICATIONS

This application is a continuation-in-part of U.S. Pat. application Ser. No. 767,099 filed Feb. 9, 1977, by the same inventor.

BACKGROUND OF THE INVENTION

This invention relates to improved permanent pleats for draw drapes and more particularly to draw drapes containing a multiplicity of said pleats.

Draw drapes, as employed for decorative purposes and controllable concealment of areas or passages, generally consist of a flexible sheet structure of fabric or film having a stiffened border known as a "heading" contiguous to the upper edge. The heading accommodates means such as hooks whereby the drape can be suspended from a draw rod or equivalent rigid track mechanism capable of slideably adjusting the drape horizontally to a drawn, compactly folded state known as the "stacked" condition, or to its straightened, extended length.

Because the drapery is intended to have a pleasing appearance, particularly in its extended state, it is provided with pleats in the heading which have a distinctive appearance and cause formation of uniform vertical undulations extending the height of the drape. The undulations present an appearance of depth and natural fullness which is absent in a totally flat fabric. The pleats also serve as anchor sites for the hooks which engage with the draw rod.

In the case of large or heavy draperies, the pleats must be sufficiently strong to retain their configuration after long periods of time, and must contain some stress-resistant means for engagement with a drapery hook. Unlike fixed draperies or curtains which may be supported along their entire upper length by a curtain rod or similar means, draw drapes can be supported only at spaced points along the heading in order to permit the intervening portion of the heading to buckle and fold away from the draw rod during stacking. Considerable stresses therefore accumulate at these points, not only from the weight of the hanging drapery, but from laterally imposed forces applied during the drawing of the drapery. Since both sides of a draw drape are exposed to view in many instances, it is important that the rear side of the heading possess a reasonably neat appearance.

Pleats or pleat assemblies are generally made by forming a sharply defined fold or group of several closely spaced folds in the heading, and preserving the folds by sewing or other means. A multitude of such pleats are uniformly spaced along the heading. The size of the folds of the pleats and their spacing is generally such as to produce a pleated heading having about half the length of the initial unpleated heading. The drapery supporting hooks, usually S-shaped wires pointed at one end, generally engage the rear of the pleats.

Several well known types of pleats are recognized, such as the pinch, box and cartridge styles, each fabricated by a specialized method and having a distinct appearance. For example, a pinch pleat, also known as a French pleat, is made by first forming a vertically oriented loop protruding toward the face of the drape and extending the height of the heading. The loop is then sewn closed at its base and fashioned into three smaller loops or folds by gathering and shaping the protruding fabric and pushing it back toward the rear of the drapery. The center loop, at its rear-most extremity, is bounded by two bends, sometimes referred to as bights. The three loops are joined or pinched together by sewing in a direction perpendicular to the face of the drape just below the heading, forming a seam, generally called a bar tacking, which stabilizes the folded structure. Because the center loop is not attached at its bottom, and the three loops are secured laterally at one point, the appearance is that of three loops beginning at the top of the drapery, converging just below the heading, and diverging and leading into the undulations of the body of the drapery. Although the bights are sharply defined near the bar tacking, they are diffuse near the upper portion of the heading.

A box pleat is made by initially forming a vertically sewn loop, as in the case of the pinch pleat. The loop is then flattened against the heading, as by pressing, and the top and bottom portions of the flattened loop are horizontally sewn to the heading. A cartridge pleat is similar to a box pleat, but instead of being flattened, the loop remains in its full, protruding configuration.

The use of sewing techniques in fabricating pleats is slow and costly. Also, in the case of large pleats, sewing does not provide adequate stiffness for shape retention. Faster techniques for making pleats are desirable, and may involve stamping-type operations whereby a pleat-making means repeatedly acts upon the heading of a drapery run horizontally past the pleat-making unit. In order, however, for a pleat to be amenable to fabrication by fast automated methods such as a stamping technique, special innovations must be made in the design of the pleat itself. For example, pinch pleats containing a bar tacking are not readily amenable to fabrication by a simple stamping method.

The present invention is concerned with a pleat which may be described as a straight uniform pleat. It may have 1, 2, or 3 parallel folds or loops, each of uniform height. Unlike the pinch pleat described above, each loop is separately anchored along its base or bight and the loops do not require the bar tacking for structural stabilization. Anchoring of the loops is achieved by regions of cohesive bonding which impart strength and dimensional stability to the pleat.

Straight uniform pleats have been described in U.S. Pat. No. 2,658,551 to Bender and U.S. Pat. No. 3,392,890 to Cramer. The Bender disclosure concerns a curtain structure mounted in fixed position on a curtain rod extending through a channel associated with the heading. The channel is formed by a thermal bonding of a continuous backing strip to the rear of the heading. The pleats are formed in the heading by attachment of each loop along portions of its base to said backing strip. In view of the continuous nature of the backing strip, and the mode of engagement with a support rod, the Bender curtain cannot function as a draw drape.

Because of the incomplete attachment of the loops to the backing, the pleats of Bender sacrifice strength and dimensional stability. Likewise, use of drapery support hooks would not be feasible with the pleats of Bender because of said incomplete attachment of the loops and the absence of a reinforcing member which could endure the stresses caused by the suspended weight of the drapery.

The Cramer patent discloses the formation of parallel multifold pleats in a draw drape by means of adhesives which attach the bights of the loops to a backing strip and join the loops together laterally on the front face of the drapery. The use of a drapery hook in association with such pleats is difficult because of the presence of the adhesive and the tight compaction of the loops. Such pleats are also unusually stiff, and because of the adhesive composition may not survive aging or cleaning or laundering operations.

Further techniques for stabilizing the configuration of pleats have been disclosed in U.S. Pat. No. 3,559,717 to Kalder and U.S. Pat. No. 3,132,686 to Judovits. Such constructions however, are not amenable to fabrication by a stamping method, and involve incorporation of specially shaped rigid devices. For reasons of economy, it is preferable to avoid the need for specially shaped devices, and instead to fabricate the pleat entirely from flat materials such as fabric and film generally available for use in the manufacture of drapery.

Additional discussion of background technology may be found in the attached Prior Art Statement which is hereby made a part of this specification.

It is accordingly an object of the present invention to provide a draw drape containing pleats comprised of one, two or three straight uniform loops and capable of engaging with a hook for the suspension of said drape. It is another object to provide a draw drape containing a number of equally spaced dimensionally stable pleats in the heading thereof, each pleat capable of engaging with a piercing type of S-hook for the suspension of said drape and comprised of one or more vertically oriented loops traversing the height of the heading and being unattached to each other. It is a further object of this invention to provide a draw drape containing pleats comprised of uniform parallel loops having continuous sharply defined bights, said pleats being capable of engaging with a hook for the suspension of said drape and being amenable to formation by a stamping method. It is a still further object to provide a draw drape containing a multiplicity of pleats uniformly spaced within a heading border, said pleats being of cohesively integral construction fabricated from sheet materials and capable of being penetrated from the rear by the sharpened end of an S-shaped supporting hook. Other objects and advantages will appear hereinafter.

SUMMARY OF THE INVENTION

The objects of the present invention are accomplished in general by providing a draw drape having a series of novel pleats and, in preferred embodiments, a special heading structure coactive with said pleats to produce a synergistically improved structure. The draw drape is generally comprised of a flexible sheet material having a face surface, rear surface, straight upper edge, and a stiffened heading border contiguous to said upper edge. The rear surface of said sheet, along said heading, has thermoplastic characteristics.

The pleats are located at spaced intervals within said heading. Each pleat is comprised of one, two or three vertically oriented loops disposed perpendicularly to said upper edge and protruding above the face surface of the drape. The loops are fixed in position by cohesive bonding to a reinforced backing strip having thermoplastic characteristics, said bonding occurring at the bight of each loop and at the base of the folds bracketing the pleat. The bonding is achieved in vertically elongated parallel regions extending the height of said heading. A separate backing strip is utilized for each pleat.

In a preferred embodiment, the heading is comprised of a stiffening member such as a strip of buckram sandwiched between front and rear layers of material having thermoplastic characteristics, essentially as disclosed in U.S. Pat. No. 3,084,738 to Turesdale. Said front layer is preferably a continuous extension of the face surface of said drape. The rear layer is cohesively bonded to the front layer horizontally along the upper edge of the heading and preferably also along the bottom of the heading, generally corresponding to the lower edge of the buckram strip. The bonding of front and rear layers is such as to penetrate and immobilize the buckram strip. In such preferred embodiment, the cohesive bonding of the backing strip to the bights or folds of the pleat is such as to penetrate to unify the backing strip with the rear layer, buckram strip, and front layer of said heading.

DETAILED DESCRIPTION OF THE INVENTION

Figure 1:
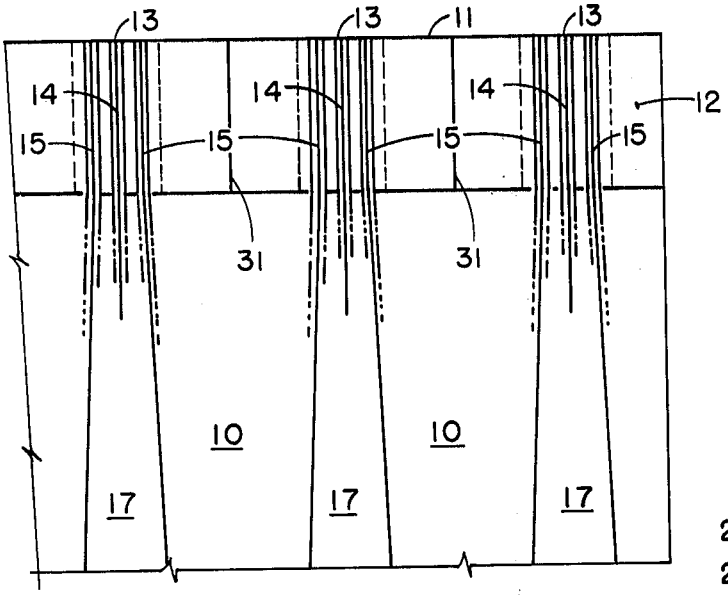
FIG. 1 is a fragmentary plan view of the upper portion of the face surface of a draw drape of the present invention in its extended state.

FIG. 1 illustrates the face surface of a draw drape of the present invention consisting of a compliant sheet 10 having a straight upper edge 11, and a stiffened upper border heading 12 containing the three identical pleat assemblies 13, each comprising a center loop 14 and outer loops 15. The loops of each pleat assembly gradually merge into the formation of a single undulation 17.

Figure 2:
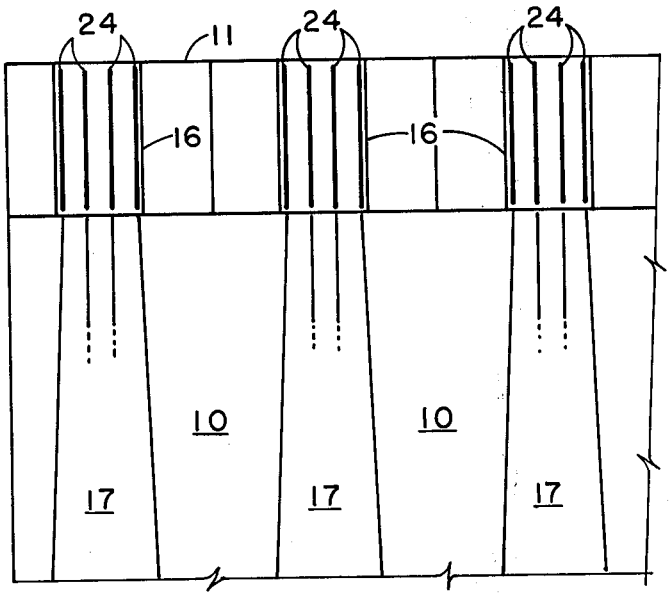
FIG. 2 is a fragmentary plan view of the upper portion of the rear surface of the draw drape of FIG. 1.

FIG. 2 is a view of the rear side of the draw drape of FIG. 1, showing backing strips 16 which constitute the rear member of each pleat assembly. Each backing strip 16 is cohesively joined to the rear of heading 12 in vertically elongated parallel regions of bonding 24 which traverse the height of said heading. Said regions of bonding 24 occur at the base of the folds 18 which lead into and bracket the pleat structure, and at the bights 19 which are the lowermost portions of the loops, being the turning or transition zone where one loop runs into the next adjacent loop. The folds 18 may be characterized as regions of the heading having an essentially right angle bend or fold leading into a loop.

Figure 3:
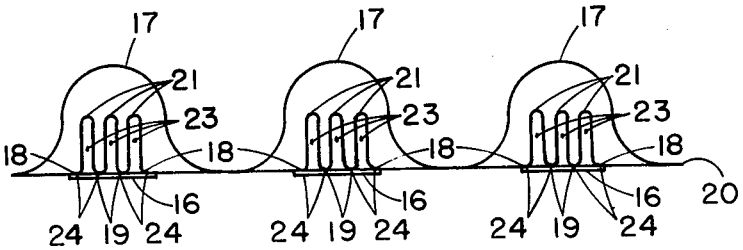
FIG. 3 is a fragmentary top view of the draw drape of FIG. 1.

The loops, containing unobstructed interiors such as hollow spaces 23, extend in the direction of the face of the drapery. The bases or bights of said loops originate at the general plane of the drapery which includes the unpleated portions of the heading and is denoted by the numeral 20 in FIG. 3. The loops extend to rounded peaks 21 generally located at equal heights above the plane 20 of the drapery. A drapery hook 22 shown in FIG. 4 penetrates backing strip 16, entering the hollow space of center loop 14.

The drapery is fabricated from a compliant, flexible film or fabric material or combinations thereof. Fabrics having a woven, knitted or random non-woven structure of fibrous material may be utilized, and the fabric may be coated or impregnated with thermoplastic material such as poly(vinylchloride). Film materials of suitable thickness and dimensional stability may be employed, and laminated materials comprised of layers of film and fabric may also be utilized. It is important that the drapery material be sufficiently supple so as to conform to the undulating contour imposed by the pleats.

Figure 4:
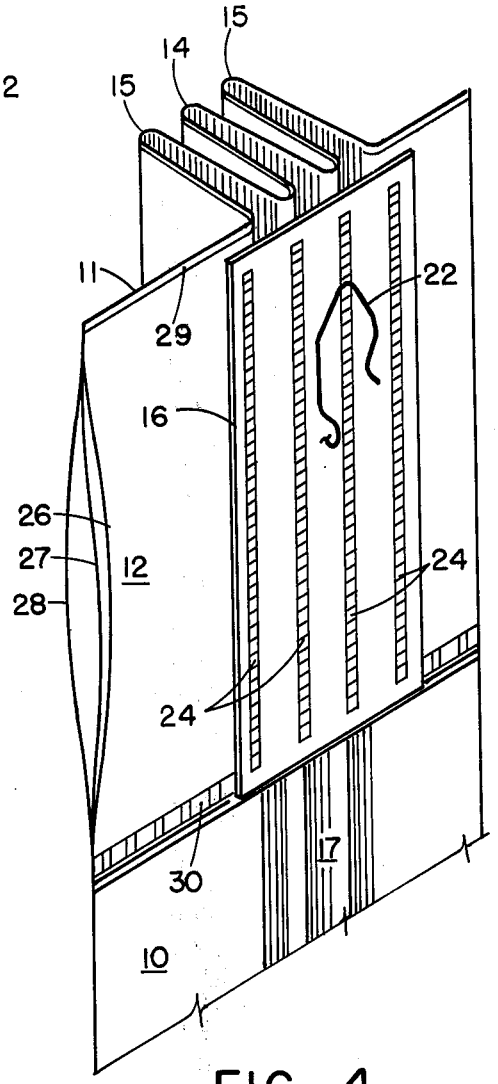
FIG. 4 is an enlarged perspective view of one of the pleats of FIG. 1.

The heading is stiffer than the remainder of the drapery but still sufficiently flexible to permit formation of the loops of the pleats, and to permit buckling between the pleats when the drapery is drawn to its compact or stacked position. The stiffening of the heading is generally accomplished by attaching to the rear of the upper border a stiff material such as a buckram or non-woven fabric. Attachment of the stiffening material may be via sewing, stapling, adhesives, or other conventional means, or by thermal bonding. The preferred heading for use in the practice of this invention, as shown in FIG. 4, has a composite structure comprising a rear layer 26 running along the upper border of the rear side of the drapery with a coextensive length of stiffening material 27 sandwiched between said rear layer 26 and front layer 28 which is continuous with the face material of the drapery. The composite heading is consolidated by an upper horizontal region of bonding 29 and lower horizontal region of bonding 30. The height of the heading may range from about 2 inches to 6 inches.

The bottom edge of the drapery may be weighted to impart conformational stability, and both sides and the bottom of said drapery will generally contain seamed hems.

The backing strip is comprised of plastic material on at least the surface which bonds to the heading. In a preferred embodiment, the backing strip is fabricated from a supple flat fabric-reinforced plastic material capable of being punctured by a sharp pin, yet highly tear-resistant. The backing strip generally has a flat rectangular shape, one dimension traversing the height of the heading, and the other dimension spanning the several loops of the associated pleat assembly. It is generally preferable tht said thermoplastic material be essentially the same as the thermoplastic material utilized on the heading, the preferred thermoplastic material being plasticized poly(vinylchloride). The plasticizer is generally a non-volatile ester such as dioctyl phthalate, and it may be present in an amount ranging from about 20% to 80% of the total plasticized composition.

The expression "cohesive bonding", as employed herein is intended to denote a bond wherein one member attaches to another with no intervening interface or change in composition. When such bonds are broken, as in strength testing, the bonding force recorded is essentially the cohesive strength of the material involved. Such cohesive bonding may be achieved by ultrasonic or thermal methods which cause diffusion and intermingling of surface molecular layers.

The bonding of the backing strip to the rear surface of the heading is accomplished preferably by thermal means, forming vertically elongated regions of bonding at the bases of the folds leading into the pleat assembly and the bights of the interior loops. The bonding is preferably achieved by high frequency dielectric heating in a stamping type operation as disclosed in U.S. Pat. application Ser. No. 767,100, entitled "Process and Apparatus for Forming Pleats in a Draw Drape", filed of even date herewith by the same inventor. To insure adequate strength of bonding it is preferred that said regions of bonding have an essentially rectangular shape, with a width between 1/16" and ⅜", a length between about 2" and 6", and a total area of at least 0.1 square inch. The regions of bonding are spaced between ⅛" and 1" apart. When utilizing the preferred composite heading construction, the nature of the thermal bonding is such as to unite the backing strip with the rear layer, buckram strip and front layer of said heading. Dielectric heating is rapid and obviates the need for adhesives which must be inserted between members to be bonded. Accordingly, it facilitates the use of a rapid stamping method for fabrication of the pleat assembly of this invention.

The pleat assemblies are uniformly spaced between about 4 and 15 inches apart in the heading of the drapery. Although each pleat assembly may be comprised of 1, 2 or 3 loops, the use of 2 loops is preferred because of ease of manufacture by a stamping method. The height of the loops, measured from the plane of the drapery 20 to the peaks 21 may range from about ½" to 1½". It has been found that, in order to preserve a desirable conformation in the pleat assembly, a critical interrelationship exists between the height of the loops and the spacing of the regions of bonding. Specifically, it has been found that the ratio of distance between vertically elongated regions of bonding/height of the loops is between 0.2 and 0.8. In the special case of a 3 loop pleat assembly, the two outermost loops may be either higher, lower, or the same height as the center loop.

in all embodiments, each loop is of substantially constant height throughout its length, and the loops of a single multiloop pleat are separate and parallel. All bonding of the loops occurs within a single plane, namely the plane of the drape or backing strip. There is no bar tacking or bonding in a direction perpendicular to the face of the drape, as occurs in conventional pinch pleats. Such characteristics cause the pleats of this invention to be clearly distinguishable in appearance from conventional pinch pleats, and facilitate fabrication by a stamping operation.

in a further preferred embodiment of the present invention, it has been found that easier and more uniform stacking of the draw drape can be achieved, and greater packaging compaction for purposes of shipment can be achieved by providing, mid-way between pleats, pilot seams as represented by numeral 31 in FIG. 1. The pilot seams, which unite the component members of a composite heading are regions of bonding which can be formed by dielectric heating, and predispose the heading to buckle outwardly, away from the draw rod during stacking. This function overcomes the natural tendency of a drapery heading to rub against the draw rod and resist outward folding, or fold in an unpredictable manner, especially when utilizing puncturing-type supports such as hook 22.

What is claimed is:

1. A draw drape comprising:

(a) a compliant sheet having a face surface, rear surface and straight upper edge, (b) a stiffened heading border contiguous to said upper edge having thermoplastic characteristics, and (c) a series of straight uniform pleat assemblies located at uniformly spaced intervals within said border, each assembly comprising at least one and not more than three separate loops disposed perpendicularly to said upper edge and protruding above the face surface of said sheet, said loops being fixed in position by cohesive bonding to a flat, tear-resistant backing strip comprised of thermoplastic material, said bonding occurring in vertically elongated regions at the bases of the folds bracketing said loops and at the bight of each loop in the case of pleats having two or three loops, whereby each loop in conjunction with said backing strip defines a hollow space into which a support hook may be inserted, said assemblies being amenable to fabrication by a stamping method.

2. A draw drape in accordance with claim 1 wherein said heading border is a composite sheet structure comprised of a stiffening member sandwiched between front and rear layers of material having thermoplastic characteristics and cohesively consolidated in at least one zone horizontally coextensive with said heading, and wherein said vertically elongated regions of bonding effect further consolidation of said composite heading border.

3. A draw drape in accordance with claim 1 wherein said bights are uniform, continuous and sharply defined.

4. A draw drape in accordance with claim 1 wherein said front layer of said composite heading border is continuous with the face surface of said compliant sheet and integral therewith.

5. A draw drape in accordance with claim 1 wherein a separate backing strip is utilized for each pleat assembly, said backing strip having an essentially rectangular configuration.

6. A draw drape in accordance with claim 1 wherein said backing strip is a thin, supple sheet-like member capable of being pierced by a sharp pin.

7. A draw drape in accordance with claim 1 wherein said vertically elongated regions of bonding are continuous and coplanar, and traverse substantially the entire height of said heading border.

8. The draw drape of claim 1 wherein the height to which each loop protrudes above the face surface of said sheet is constant throughout the length of said loop.

9. A draw drape in accordance with claim 1 wherein said elongated regions of bonding are of essentially rectangular shape, having a width between about 1/16" and ⅜", a length between about 2" and 6", and a total area of at least 0.1 square inch.

10. A draw drape in accordance with claim 1 wherein said thermoplastic material is plasticized poly(vinylchloride).

11. A draw drape in accordance with claim 9 wherein the ratio of the spacing between the regions of bonding to the height of said loops is between about 0.2 and 0.8.

12. A draw drape in accordance with claim 1 wherein pilot seams are disposed in said border midway between said pleat assemblies.

* * * * *